US008566989B2

(12) United States Patent
Yoo et al.

(10) Patent No.: US 8,566,989 B2
(45) Date of Patent: Oct. 29, 2013

(54) CONTROLLING METHOD OF CLOTHES TREATING APPARATUS

(75) Inventors: Hea Kyung Yoo, Seoul (KR); Dae Yun Park, Seoul (KR); Jong Seok Kim, Seoul (KR); Dong Won Kim, Seoul (KR); Sog Kie Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 707 days.

(21) Appl. No.: 12/671,759

(22) PCT Filed: Aug. 4, 2008

(86) PCT No.: PCT/KR2008/004521

§ 371 (c)(1),
(2), (4) Date: Feb. 2, 2010

(87) PCT Pub. No.: WO2009/020328

PCT Pub. Date: Feb. 12, 2009

(65) Prior Publication Data

US 2011/0030147 A1 Feb. 10, 2011

(30) Foreign Application Priority Data

Aug. 3, 2007 (KR) ..... 10-2007-0078138
Apr. 1, 2008 (KR) ..... 10-2008-0030388

(51) Int. Cl.

| | |
|---|---|
| ***D06F 35/00*** | (2006.01) |
| ***D06B 19/00*** | (2006.01) |
| ***D06B 23/00*** | (2006.01) |
| ***D06B 1/00*** | (2006.01) |

(52) U.S. Cl.
USPC ..... 8/149.3; 8/149.2; 8/137; 8/158; 137/387; 137/395; 137/551; 137/558; 137/559

(58) Field of Classification Search
USPC ..... 8/137, 149.2, 149.3, 158; 137/387, 395, 137/551, 558, 559
See application file for complete search history.

(56) References Cited

U.S. PATENT DOCUMENTS

| | | | | |
|---|---|---|---|---|
| 2005/0034489 | A1 | 2/2005 | Oh et al. | 68/5 |
| 2005/0115120 | A1 * | 6/2005 | Cevik | 38/14 |
| 2007/0131257 | A1 | 6/2007 | Lee et al. | 134/56 |

FOREIGN PATENT DOCUMENTS

| | | | | |
|---|---|---|---|---|
| CN | 101055070 | A | | 10/2007 |
| DE | 44 32 489 | A1 | | 3/1996 |
| DE | 102 60 151 | A1 | | 7/2004 |
| EP | 1 441 059 | A1 | | 7/2004 |
| EP | 1 548 177 | A1 | | 6/2005 |
| EP | 1 666 655 | | | 6/2006 |
| EP | 1 734 170 | B1 | | 12/2006 |
| EP | 1 3734 170 | A | | 12/2006 |
| EP | 1 813 709 | A2 | | 8/2007 |
| EP | 1 900 865 | A1 | | 3/2008 |
| EP | 1 900 868 | A1 | | 3/2008 |
| EP | 1 936 023 | A1 | | 6/2008 |
| KR | 10-2006-0035385 | | | 4/2006 |
| WO | WO 03/074778 | A1 | | 9/2003 |
| WO | WO 2006/091057 | A1 | | 8/2006 |
| WO | WO 2006/100335 | | * | 9/2006 |
| WO | WO 2006/100335 | A1 | | 9/2006 |
| WO | WO2007/145451 | | * | 12/2007 |
| WO | WO 2007/145451 | A2 | | 12/2007 |
| WO | WO 2008/004802 | A2 | | 1/2008 |
| WO | WO 2008/010670 | A2 | | 1/2008 |
| WO | WO 2008/030053 | A2 | | 3/2008 |

OTHER PUBLICATIONS

Translation WO 2006/100335.*
European Search Report dated Jul. 24, 2009 for Application No. 09156729.7.
European Search Report dated Mar. 14, 2011 issued in Application No. 08 79 3035.
United States Office Action dated Jun. 18, 2012 issued in U.S. Appl. No. 12/385,065.
European Search Report dated Jun. 28, 2011 issued in Application No. 09 156 729.
PCT International Search Report and Written Opinion dated Jul. 29, 2010 issued in Application No. PCT/KR2008/004521.
Chinese Office Action issued in CN Appln. No. 200880104765.2 dated Jun. 18, 2013.

* cited by examiner

*Primary Examiner* — Lorna M Douyon
*Assistant Examiner* — Amina Khan
(74) *Attorney, Agent, or Firm* — KED & Associates, LLP

(57) ABSTRACT

A clothing treating apparatus and a method of controlling such an apparatus are provided. The clothing treating apparatus may make use of a draining function which may be automatically or manually performed after determining whether or not water received in a detachable water supply tank may be re-used or not.

11 Claims, 4 Drawing Sheets

CONTROLLING METHOD OF CLOTHES TREATING APPARATUS

TECHNICAL FIELD

The present invention relates to a clothes treating apparatus and a controlling method of the same. More particularly, the present invention relates to a clothes treating apparatus, which can drain water inside a detachable water supply tank by using a draining path in the clothes treating apparatus, and a controlling method of the same.

In particular, according to the clothes treating apparatus and the controlling method of the same of the present invention, it is possible to automatically or manually provide a draining function after determining whether water inside the water supply tank can be reused or not.

BACKGROUND ART

A cabinet-type clothes treating apparatus (hereinafter, referred to as the "clothes treating apparatus") and a drum-type steam dryer (hereinafter, referred to as a "steam dryer") are typical examples of an apparatus for treating clothes by means of steam.

Generally, a clothes treating apparatus is an apparatus for treating clothes received in an accommodating space provided in a cabinet. The treating of the received clothes means a series of processes that remove smells, creases or moistures kept inside the clothes by blowing air to the clothes or by supplying steam or hot air to the clothes so as to provide satisfaction to customers who wear the clothes.

For example, if a person wears same clothes more than one time, smells, creases or moistures remains in the clothes. The smells kept in the clothes give discomfort to users who are trying to wear the same clothes again. Although clothes can be washed to remove this, however there are problems in that frequent washings may reduce the lifetime thereof and increase costs necessary to maintain the clothes.

Also, creases may be present in clothes which are washed and dried, in that case the user has to iron the clothes before putting them on.

In order to solve these problems, the clothes treating apparatus can be used to remove smells, creases or moistures remained in the clothes.

The clothes treating apparatus may blow air (including hot air) in order to supply moisture into the clothes and to dry the clothes having moisture by means of the supplied steam.

Although smells, creases or moistures can be removed by exposing clothes to the air or hot air, however moisture can be used to maximize the effects.

If moisture is supplied into clothes received in the clothes treating apparatus, minute water particles are coupled with microfragnances remained deep into fibers, and the water particles coupled with the microfragnances are separated and discharged during a drying process. In this way, smells remained in the clothes are removed.

And, if steam is supplied into clothes received in the clothes treating apparatus, creases remained in the clothes are moderated. The creases in the wet clothes caused by the supplied steam are moderated or removed during the drying process.

By means of the processes, smells, creases or moistures kept in the clothes can be removed, and therefore the user can put on the clothes in a pleasing state.

And, a general drier is an electric home appliance that dries washed laundries, i.e. clothes, by using hot air. Generally, the drier includes a drum in which objects to be dried are accommodated, a drive source which drives the drum, a heating means which heats air to be introduced into the drum, and a blower unit which sucks or discharges air inside the drum.

Generally, the drier dries the laundries as the dehydrated laundries are put therein. However, creases are formed in the washed laundries, and the produced creases are not completely removed in the drying process. Therefore, the conventional drier has a disadvantage in that ironing is required to remove the creases present in the dried laundries.

Also, wrinkles, creases and folds are formed while clothes are stored or used. Therefore, there has been a need to provide a device that can easily remove folds caused by the use or storage, and thus, a steam drier which supplies steam into clothes during the drying process is developed accordingly.

Therefore, a validity period of water to be used as a water source may exist, in case the water source which supplies water into a moisture supply apparatus is configured as a detachable type or in case a drain space where condensate water condensed at an inner portion of the accommodation space or drainage water is collected is provided.

If the validity period of water stored in the detachable water source has been expired, the water is no bigger than drainage water since the water is no longer supplied into the accommodation space.

Also, various parts may be corroded and smells may be occurred, since various pollutants may be included in water stored in the drain space.

Therefore, a method, which can solve the above problems caused when the water source or the drain space is detachably configured, is required.

DISCLOSURE OF INVENTION

Technical Problem

The present invention relates to a clothes treating apparatus and a controlling method of the same. More particularly, an object of the present invention is to provide a clothes treating apparatus, which can drain water inside a detachable water supply tank by using a draining path in the clothes treating apparatus, and a controlling method of the same.

Also, another object of the present invention is to provide a clothes treating apparatus, which automatically or manually accomplishes a drain function by determining whether water inside the water supply tank can be re-used, and a controlling method of the same.

Also, further another object of the present invention is to provide an improved clothes treating apparatus which can prevent smells, caused as the result of the contamination of condensate water stored in the condensate water drain path.

Technical Solution

To achieve the object and other advantages and in accordance with the purpose of the invention, as embodied and broadly described herein, there is provided a controlling method of a clothes treating apparatus that treats received clothes by using steam generated in a steam generator, including: a water supply tank draining step of draining water inside a detachable water supply tank, which supplies water to the steam generator, into a detachable drain tank via the steam generator.

And, the controlling method further includes a judging step of determining whether water inside the water supply tank may be used in the steam generator, wherein the water supply tank draining step may be performed according to the result of the judging step.

Here, the judging step includes a storage period comparing step of comparing a validity period of water with a storage period of water inside the water supply tank, wherein water may be determined to be used when the storage period is shorter than the validity period.

In that case, the storage period of the water supply tank may be reckoned from a recent mounting time point of the water supply tank.

Also, a starting point of the storage period of the water supply tank may be reckoned from the time when the steam generator starts to generate steam recently.

Here, the controlling method may further include a first alarm step of showing the judgement to the user, when re-use is not determined in the judging step.

And, after the first alarm step, the water supply tank draining step may be automatically performed.

Here, the water supply tank draining step is performed when a drain signal is input.

In that case, the water supply tank draining step is performed when a drain signal is input.

Also, the controlling method may include a second alarm step of alarming necessity of water supply when the water supply tank draining step is terminated.

Here, the controlling method may include a second alarm step of alarming necessity of water supply when the water supply tank draining step is terminated.

Also, in another aspect of the present invention there is provided a controlling method of a clothes treating apparatus that treats clothes by supplying steam generated in a steam generator into an accommodating space where the clothes are received, including: a water collecting tank water-supplying step of supplying water inside the steam generator into a water collecting tank where water drained from the clothes treating apparatus is stored.

And, The controlling method may further includes a water collecting tank draining step of draining water inside the water collecting tank into a detachable drain tank.

Here, the water collecting tank draining step may be performed by the operation of a drain pump provided on a pipe that connects the water collecting tank with the drain tank.

In that case, the water collecting tank water-supplying step is performed after a steam supplying step of supplying steam from the steam generator to the accommodating space.

Also, water to be supplied into the water collecting tank during the water collecting tank water-supplying step may be supplied from a water source, which supplies water into the steam generator, into the water collecting tank.

Here, the water collecting tank water-supplying step is performed by opening a control valve provided on a pipe that connects the steam generator with the water collecting tank.

And, the water collecting tank further includes a water-level sensor that measures the level of water by sensing whether electric current is flowed through electrodes inside the water collecting tank, and the controlling method may further include a water-level measuring step of measuring the level of water in the water collecting tank by means of the water-level sensor, before the water collecting tank water-supplying step.

Here, the water collecting tank water-supplying step may be performed when the level of water in the water collecting tank is below the predetermined level of water.

In that case, the controlling method may further include a preliminary draining step of draining a predetermined amount of water from the water source into the drain tank via the steam generator and water collecting tank after a water collecting tank draining step for draining some or all of water inside the water collecting tank is performed, when the level of water inside the water collecting tank is above the predetermined level of water.

Also, the water collecting tank water-supplying step may be performed after condensate water, generated in a dehumidification process for dehumidifying air in the accommodating space, is collected in the water collecting tank.

Also, in further another aspect of the present invention, there is provided a controlling method of a clothes treating apparatus that treats clothes by supplying steam generated in a steam generator into an accommodating space where the clothes are received, including: a water collecting tank diluting step of diluting water inside a water collecting tank where water inside the steam generator and condensate water of the clothes treating apparatus are collected.

Here, the controlling method may further include a steam generator water-supplying step of selectively supplying water from a water source, which supplies water to the steam generator, into the steam generator according to the level of water in the steam generator, after the water collecting tank diluting step.

And, the water collecting tank diluting step may be performed after at least one of a steam supplying step of supplying steam into the accommodating space and a drying step of drying air in the accommodating space is accomplished.

Advantageous Effects

According to the clothes treating apparatus of the present invention, the user will be satisfied with the result that smells, creases or moistures remained in clothes are removed by supplying steam or hot air into the clothes.

Also, in case a detachable water supply tank is used as the water source of the clothes treating apparatus, water stored in the water supply tank can be drained via the draining path. Here, water inside the water supply tank can be automatically or manually drained according to the decision of the user.

Further, the clothes treating apparatus according to the present invention may prevent smells or corrosion, which may caused while storing or draining the contaminated condensate water. Here, there will be an effect of washing out the drain path of the condensate water by using remained water in the steam generator.

BEST MODE FOR CARRYING OUT THE INVENTION

Figure 1:
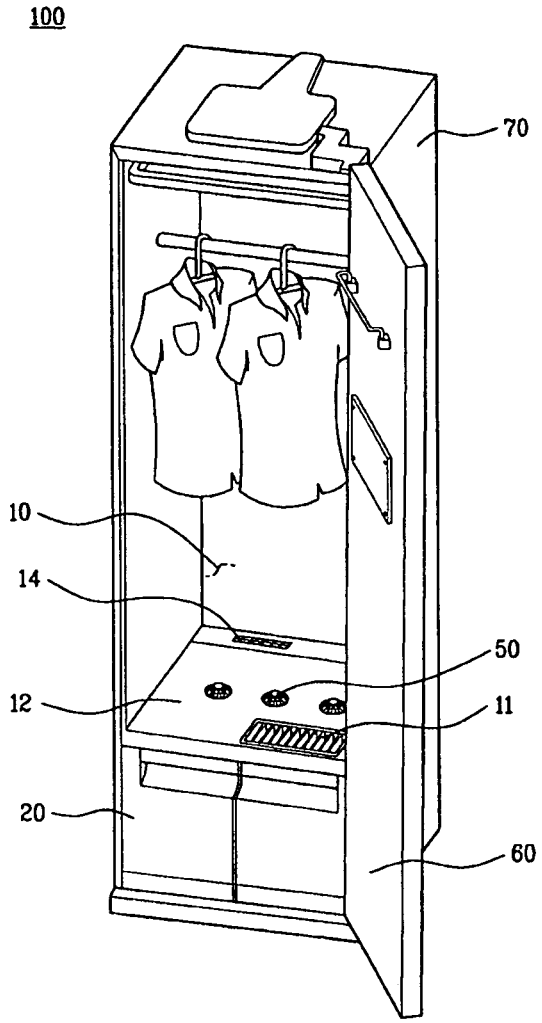
FIG. 1 is a perspective view of a clothes treating apparatus according to the present invention.

Hereinafter, preferred embodiments of the present invention will be explained in detail with reference to the accompanying drawings. However, the present invention is not limited to the exemplary embodiments disclosed hereinafter, but may be implemented in diverse forms. The matters defined in the description are nothing but specific details provided to assist those of ordinary skill in the art in a comprehensive understanding of example embodiments, and example embodiments are only defined within the scope of the appended claims. In the entire description of example embodiments, the same reference numerals are used for the same elements across various figures.

A clothes treating apparatus and a steam dryer, which treat clothes in a manner that dry the clothes after supplying steam to them, will be explained by focusing on a case that uses a detachable drain tank. And, since principles of supplying steam and returning condensate water are common, a cabinet-type clothes treating apparatus will be explained with reference to the drawings.

Also, a steam generator of the clothes treating apparatus according to the present invention is just an example of a moisture supply apparatus for supplying moisture to clothes received therein. Therefore, the type of moisture is not limited to steam but may, for example, include sprayed water. Hereinafter, a case using the steam generator will be explained for the sake of convenience.

Figure 2:
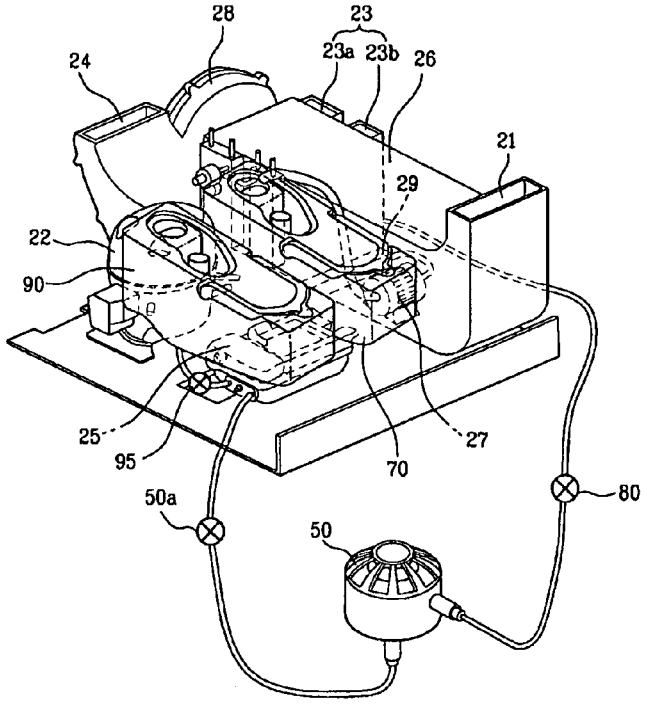
FIG. 2 shows an inner structure of a mechanism compartment of a clothes treating apparatus according to the present invention.

FIG. 1 is a perspective view of a clothes treating apparatus according to the present invention, and FIG. 2 shows an inner structure of a mechanism compartment of a clothes treating apparatus according to the present invention.

As shown in FIG. 1, the clothes treating apparatus 100 according to the present invention includes an accommodating space 10 in which clothes are received, and a mechanism compartment 20 which is disposed at a lower portion of the accommodating space 10 and is provided with various parts for removing creases, smells or moisture remained in the clothes by dehumidifying, heating of circulating air in the accommodating space 10.

The accommodating space 10 and mechanism compartment 20 may be provided in one cabinet 70, and the accommodating space 10 is opened/closed by a door 60.

The mechanism compartment 20 may suck air in the accommodating space 10 and re-supply it to the accommodating space 10. In a bottom surface 12 of the accommodating space 10, a suction port 11 through which air in the accommodating space 10 is introduced and a discharge port 14 through which air to be re-supplied is discharged are provided.

The reason why the suction port 11 and discharge port 14 are provided in the bottom surface of the accommodating space 10 is because the mechanism compartment 20 is disposed below the accommodating space 10.

Also, a steam spraying unit 50, by which steam generated from the steam generator provided in the mechanism compartment 20 is sprayed, is provided at the accommodating space 10.

A net-shaped structure may be installed at the suction port 11 and discharge port 14 in order to prevent foreign materials above a certain size from introducing from the outside.

FIG. 2 is a schematic diagram of an inner structure of a mechanism compartment 20 of a clothes treating apparatus according to the present invention.

The mechanism compartment 20 of the clothes treating apparatus includes a steam generator (moisture supply apparatus) 25 which generates steam to be supplied to the accommodating space in which clothes are received, and a hot air supply apparatus which arks humid air in the accommodating space 10 and dehumidifies or heats it in order to dry or heat the received clothes. According the hot air supply apparatus, air to be circulated in a circulation duct 26 may be dehumidified or heated by heat-exchanging with refrigerant at a heat exchanger 23 provided therein.

Of course, the circulation duct 26 has a blowing function that circulates unheated air by simply blowing the air. This blowing function is performed by a blowing duct 28 having a fan so that air routed from the circulation duct 26 is discharged through the discharge port 14.

The circulation dirt 26 is classified into a circulation (hut using a heat pump and a circulation dirt using an electric heater depending on how to heat dehumidified air.

In either case a heat pump or an electric heater is used as a means for heating air to be re-supplied to the accommodating space 10, a dehumidification process is performed by condensing humid air introduced through the suction port 11.

As shown in FIG. 2, in case the heat pump is provided to heat the dehumidified air, a condensing part 23*b* that dehumidifies humid air by evaporating refrigerant compressed from a compressor 22 and a heating part 23*a* that heats the dehumidified air by condensing the refrigerant are provided in the circulation duct 26.

Even when the heat pump is used to dehumidify and heat humid air, a separate electric heater may also be further provided to sufficiently heat the dehumidified air.

Also, the clothes treating apparatus having a drying function may be classified into a condensing-type clothes treating apparatus and an exhausting-type clothes treating apparatus depending on how to dry clothes.

That is, the clothes treating apparatus may be classified into an exhausting-type clothes treating apparatus and a circulating-type clothes treating apparatus according to whether according to whether humid air is re-supplied to the accommodating space 10 or is discharged to the outside after inhaling the humid air in the accommodating space 10, however the clothes treating apparatus according to the present invention is the circulating-type clothes treating apparatus that circulates and dehumidifies air in the accommodating space 10, and therefore the circulating-type clothes treating apparatus will be explained below.

Therefore, the air introduced the circulation duct 26 is dehumidified by the condensing part 23*b* and is heated by the heating part 23*a*, and it is re-supplied to the accommodating space via the blowing duct 28.

A discharge hole 24 which is fluidly communicated with the discharge port 14 of the accommodating space 10 is formed at the blowing duct 28, and a suction hole 21 which is fluidly communicated with the suction port 11 of the accommodating space 10 is formed at the other end of the circulation duct 26.

The heat exchanger 23 according to the present invention dehumidifies humid air circulated through the accommodating space 10 by using refrigerant supplied from the compressor 22 during an evaporation process of the refrigerant, and reheats the air dehumidified through a condensation process of the refrigerant.

The compression of the refrigerant is required between the evaporation and condensation processes. The compression of the refrigerant is carried out at the compressor 22 provided in the mechanism compartment 20.

In the mechanism compartment 20 shown in FIG. 2, a drain tank 70 is provided. Condensate water condensed at the heat exchanger 23 is temporarily collected in a water collecting tank 29 dispoed below the heat exchanger 23, drainage water collected in the water collecting tank 29 is flowed to the drain tank 70 and is stored therein.

The water collecting tank 29 also has a function of temporarily storing remained water or condensate water of the accommodating space in order to discharge remained water in the steam generator 25 or condensate water of the accommodating space to the drain tank 70, as well as the water collecting tank collects condensate water of the heat exchanger in the circulation duct 26.

Here, condensate water having more pollutants than others is the condensate water condensed at the heat exchanger 23. The condensate water may have various foreign materials because it is formed as moisture of air in the accommodating space is condensed. Accordingly, if the condensate water is immediately discharged to the drain tank, an offensive smell may be generated from the drain tank. The method of relieving this will be explained below.

The drain tank 70 can be an outside sewerage pipe instead of being a detachable pipe. However, the drain tank 70 configured as a detachable water tank will be explained because, otherwise, the clothes treating apparatus has to be installed at a location where a sewer system is available.

An user of the clothes treating apparatus selectively separates the drain tank 70 from the mechanism compartment 20 by considering the capacity of the drain tank 70, and therefore he can discharge drainage water stored therein. The movement of drainage water from the water collecting tank 29 to the drain tank 70 may be performed by a drain pump 27 and the like. The drain pump 27 can be embedded in the water collecting tank 29.

Also, the water collecting tank 29 may include a water-level sensor (not shown) which is able to measure the level of water by sensing whether electric current is flowed through electrodes in the water collecting tank 29. The reason why this water-level sensor is provided is to determine a point of time that drains water in the water collecting tank 29 off. That is, since condensate water condensed at the heat exchanger 23 and so on is not drained into the drain tank 70 but is stored in the water collecting tank 29, water in the water collecting tank 29 is required to be drained into the drain tank 70 when the water collecting tank is full of water, and therefore the water-level sensor may be provided to determine the level of water in the water collecting tank.

The reason why the separate water collecting tank is provided will be explained as follows. If the drain tank 70 can be disposed below the heat exchanger 23, the water collecting tank 29 can be abbreviated, however the drain tank may be provided at an upper portion of the mechanism compartment by using the pump in order to allow the drain tank 70 to be detachably coupled with the mechanism compartment.

That is, it is necessary to make up for height difference by means of the drain pump 27, since the drain tank 70 is preferably disposed above the mechanism compartment 20 so that the user can easily detach/attach the drain tank 70 from/to the mechanism compartment 20.

In case the drain tank 70 and a water supply tank 90 to be explained are detachably installed, it is preferable that they are configured to be drawn from or pivoted around the mechanism compartment in a state where they are installed at a drawer (not shown) which is movably or rotatably provided at the mechanism compartment 20.

Since drainage water is transferred from the water collecting tank 29 to the drain tank 70 by using the drain pump and the like, the size of the water collecting tank 29 can be smaller than the drain tank 70.

The steam to be supplied to the clothes received in the accommodating space 10 is generated as the steam generator 25 provided in the mechanism compartment 20 heats water supplied from the water supply tank 90 provided in the mechanism compartment, and is supplied to the accommodating space 10.

The water supply tank 90 can be configured as a water tank which is detachable from the mechanism compartment, the same as the drain tank 70 in FIG. 2.

Since the amount of water necessary to produce steam is not abundant and installation is required where no waterworks is available, a detachable water supply tank 90 is preferable used. Of course, in case the waterworks is located adjacently, the water supply tank 90 is also directly connected to the waterworks.

The water supply tank 90 supplies water to the steam generator 25, and the steam generator 25 supplies steam into the received clothes via the steam spraying unit.

In the embodiment shown in FIG. 2, the steam spraying unit 50 through which steam supplied from the steam generator 25 is sprayed is described as a steam spraying unit. Although a plurality of steam spraying units 50 are installed at the bottom surface 12 of the accommodating space according to FIG. 1, however one steam spraying unit 50 will be explained for the sake of convenience, as shown in FIG. 2.

The suction or the discharge of air in the accommodating space through the circulation dart 26 is carried out by a blower fan 28*a* in the blowing duct 28 located adjacent to the circulation dirt 26.

The air in the accommodating space, which is sucked through the suction hole 21 fluidly communicated with the suction port 11 in the accommodating space 10, is transferred to the discharge hole 24 via the heat exchanger 23 and is discharged to the accommodating space 10 through the discharge hole of the accommodating space 10.

The steam generator 25 according to the present embodiment generates steam as a specific amount of water accommodated in a water tank of a specific size is heated by an embedded heater. However, according to the present invention, any device capable of producing steam can be used as the steam generator. For example, it is also possible to heat water by directly installing a heater to the periphery of a water supply hose through which water passes, i.e. without storing water in a specific space.

Since water in the steam generator 25 may cause the failure of the embedded electric heater and be contaminated even through the water is not used for producing steam, remained water in the steam generator 25 should be withdrawn, and the place where the remained water is withdrawn may be one of the water supply tank 90 or the drain tank 70.

If the remained water is discharged to the drain tank 70, it will be drained via the water collecting tank 29.

The steam generator 25 supplies steam into the accommodating space, in which clothes are accommodated, via the steam spraying unit 50.

The steam spraying unit 50 is connected with the steam generator 25, and it can be configured that condensate water thereof is discharged to the drain tank 70.

In order to directly drain the condensate water from steam into the drain tank 70, the condensate water from steam may be directly connected to the water collecting tank 29 or be connected to the condensing part 23*b* in the circulation dirt 26 connected with the water collecting tank 29.

In the latter case, it is possible to drain the condensate water from steam together with condensate water condensed at the condensing part 23*b* into the drain tank 70 via the water collecting tank 29. A method of simplifying the structure is used by considering the length of pipes that connect each of parts.

Even though the condensate water condensed in the steam spraying unit 50 can be discharged to the drain tank 70 right after the condensate water is generated, however it is preferable to allow the condensate water to be evaporated by staying it in the steam spraying unit for a predetermined time rather than to discharge it right away because the condensate water from steam is very high temperature state.

Also, if the condensate water stays, the supplied steam can be easily sprayed because the space in the steam spraying unit 50 is diminished. And, the hot condensate water also serves to thermally insulate the supplied steam.

Therefore, the condensate water from steam, which is collected in the steam spraying unit, can be stayed in the steam spraying unit 50 for a predetermined time.

Therefore, in order to stay the condensate water in the steam spraying unit 50, a retention valve 80 may be provided between the condensate water outlet and the drain tank 70.

This is because the produced condensate water is prevented from being discharged through the condensate water outlet 53 by the valve, right after the condensate water is produced. Also, the retention valve 80 is preferably a magnetic valve which is controlled by a control unit (not shown) of the clothes treating apparatus.

Further, the condensate water condensed at the steam spraying unit 50 is not directly discharged to the drain tank 70 but is discharged thereto via the water collecting tank 29. In case the condensate water is discharged to the pump 27 after being temporarily stored in the water collecting tank 29, the condensate water can be discharged together with condensate water from the heat exchanger 23, and therefore it is convenient.

Also, the condensate water collected in the steam spraying unit 50 can be directly connected to the water collecting tank 29, however it can be also connected to the water collecting tank via the circulation duct 26. The latter is applicable when the length of pipes defining a discharge path of the condensate water is shortened or the stricture is simplified by stopping over the circulation dint 26.

The movement of condensate water from the water collecting tank 29 to the drain tank 70 is carried out by the drain pump 27 connecting both sides. The difference in height is compensated by the drain pump 27, since the drain tank 70 is located higher than the water collecting tank 29.

The drain tank 70 according to the present embodiment is provided as a detachable water tank, however water can be directly discharged from the water collecting tank in a state where sewerage system is available.

Therefore, it is preferable that a pipe, which is provided to discharge condensate water from the water collecting tank 29, is selectively connected to the detachable drain tank 70 or sewerage system (not shown).

Figure 3:
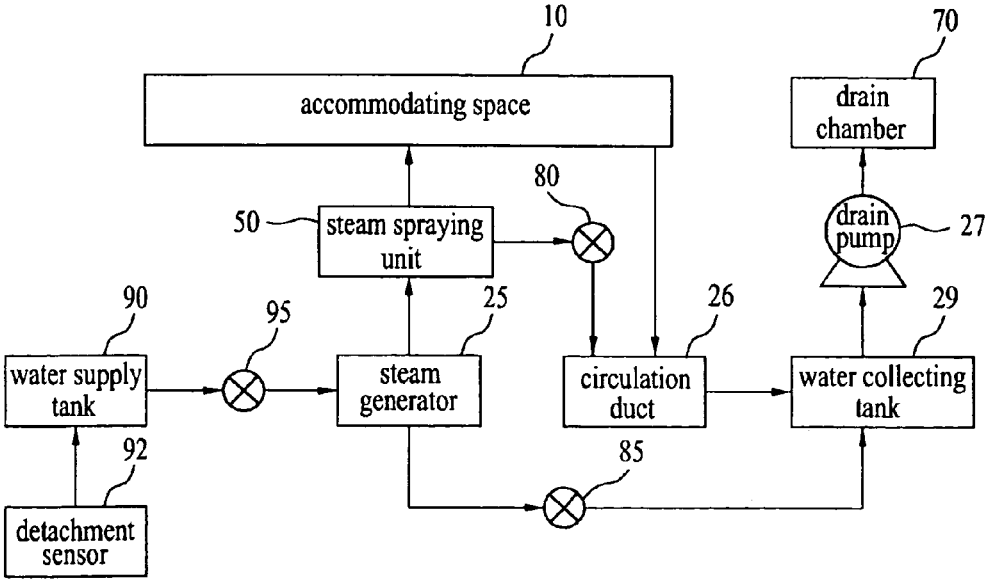
FIG. 3 is a diagram schematically showing flows of steam and condensate water of a clothes treating apparatus according to the present invention.

FIG. 3 is a diagram schematically showing flows of steam and condensate water of a clothes treating apparatus according to the present invention.

Condensate water may be produced at an inner wall of the accommodating space 10. Therefore, the condensate water has to be drained into the drain tank 70. As described above, in order to simplify pipes in the mechanism compartment 20, a method that drains the condensate water into the drain tank 70 via a condensate water accommodating space (lower space of the heat exchanger) in the circulation duct 26 or the water collecting tank 29 can be used without installing a pipe for directly connecting the accommodating space 10 with the drain tank 70.

Likewise, the steam generator 25 can allow the remained water collected therein to directly drain into the water collecting tank 29, and it can also allow the remained water to drain into the water collecting tank 29 via the circulation dirt 26.

In the embodiment shown in FIG. 3, it is configured that the remained water in the steam generator 25 drains into the drain tank 70 via the water collecting tank 29.

In addition, there is provided a controlling method of a clothes treating apparatus according to the present invention including the step of: draining water in the detachable water supply tank, which supplies water to the steam generator, into the detachable drain tank via the steam generator.

As shown in FIG. 3, the process of draining water in the detachable water supply tank 90 into the detachable drain tank 70 is routed to the steam generator 25.

Also, the steam generator 25 has to be directly/indirectly connected to the water collecting tank or drain tank in order to drain the remained water therein, and water in the water supply tank can be discharged through the draining path provided for draining the remained water.

The clothes treating apparatus according to the present invention is configured that the remained water in the steam generator 25 can be drained into the water collecting tank 29. Of course, it is also possible to drain it into the water collecting tank 29 via the condensate water accommodating space of the circulation duct 26, as described above.

A first valve is provided between the steam generator 25 and the water supply tank 90. As the first valve 95 is opened, water in the water supply tank 90 can be supplied into the steam generator. Therefore, the first valve 95 has to be opened in a water supply tank draining step of the controlling method of the clothes treating apparatus according to the present invention.

The first valve provided between the steam generator 25 and the water supply tank 90 can be applicable when the natural supply of water from the water supply tank 90 to the steam generator is available, however a separate water supply pump can be provided when the height of the steam generator 25 is equal to or higher than that of the water supply tank 90.

As water supply pump is provided, location setting in the mechanism compartment 20 can be unrestrictedly determined.

Also, a drain pump 85 may be provided between the steam generator 25 and the water collecting tank 29.

The drainage from the steam generator 25 to the water collecting tank 29 is performed by opening the drain pump 85.

Therefore, when a drain signal is input, the control unit (not shown) of the clothes treating apparatus drains water in the water supply tank 90 into the water collecting tank 29 by opening the water supply valve 95 and drain pump 85.

Referring to FIG. 2 again, since the water collecting tank 29 is provided at a bottom of the mechanism compartment, the drainage from the water supply tank 90 into the water collecting tank 29 can be performed by opening the valves without the help of a separate pump.

And, if the steam generator 25 is located at a higher elevation, it is possible to drain the remained water in the steam generator 25 by opening these valves.

Therefore, if difference in hydraulic pressure, which enables water to be drained from the water supply tank 90 to the water collecting tank 29 via the steam generator 25, does not exist in sequential processes of draining, a pump and the like has to be provided to compensate this.

A method of draining water collected in the water collecting tank 29 into the drain tank 70 is performed by the drain pump 27 provided between the water collecting tank 29 and the drain tank 70.

The drain pump 27 may compensate height difference between the water collecting tank 29 and the drain tank 70. Therefore, in case natural drainage is available, the drainage may be controlled not by the drain pump but by a separate control valve.

As described above, the draining processes from the water supply tank 90, the steam generator 25, the water collecting tank 29 to the drain tank 70 have been discussed. These draining processes are performed by opening the control valve and by operating the drain pump, respectively.

The water supply tank draining step from the water supply tank 90 to the drain tank 70 can be performed when a drain signal, which is selectively input by the user, is generated, however it is particularly advantageous in following cases.

Since there is the possibility of deteriorating and decaying water when the water is stored in the water supply tank 90 for a long period of time, it is not appropriate to supply steam into the accommodating space 10 by using water which has been stored for a long period of time.

Therefore, the controlling method of the clothes treating apparatus according to the present invention may further include the step of determining whether water inside the water supply tank 90 can be re-used in a steam generator 25 for supplying steam to the received clothes.

In the re-use determining step, if it is determined that water inside the water supply tank 90 is inappropriate for the use, a step of draining the water supply tank can be selectively performed.

The re-use determining step includes a storage period comparing step that compares a predetermined validity period of water with a storage period of water inside the water supply tank, and water is determined to be re-used when the storage period is shorter than the validity period.

The predetermined validity period of water may be saved in the control unit (not shown) of the clothes treating apparatus. Further, the storage period of water inside the water supply tank may be determined as follows.

A storage period of water can be determined by reckoning from the time when the water supply tank 90 is installed. A mounting time of the water supply tank 90 is detected by a detachment sensor which senses attachment or detachment of the water supply tank.

In the diagram shown in FIG. 3, the detachment sensor 92 is provided at a location where the attachment/detachment of the water supply tank 90 can be detected Therefore, the storage period of water inside the water supply tank 90 is reckoned from a mounting time when the water supply tank is mounted to the mechanism compartment 20 after water supply tank 90 is detached therefrom.

Therefore, if the detachment sensor 92 is provided at a location where the detachment sensor 92 is mounted into the mechanism compartment 20, the storage period of water inside the water supply tank 90 can be calculated.

Any sensor for detecting the attachment/detachment of the water supply tank 90 can be used as the detachment sensor 92. For example, it can be a switch sensor which is pressed by the water supply tank 90. Also, it can be a weight sensor which can detect the attachment of the water supply tank by sensing weight of the water supply tank.

Also, another method of reckoning the storage period of water is accomplished by reckoning a recent operating time of the steam generator. Although this method is not required to have a separate detachment sensor, however this method presupposes that fresh water will be supplied by the user before operating to generate steam.

In the latter case, the control unit of the clothes treating apparatus calculates the time when steam is recently generated from the steam generator 25, so that it can inform the user, who is willing to use the clothes treating apparatus after a considerable lapse of time longer than the validity period of water, of necessity of water replacement if the use does not replace the water supply tank.

The user can operate the steam generator without considering the signal if the user have filled the water supply tank with water, otherwise this method allows the user to fill the water supply tank 90 with fresh water.

The controlling method of the clothes treating apparatus according to the present invention further comprises a first alarm step of indicating the fact to the user when re-use is not determined in the judging step, i.e. when the water supply tank 90 has to be filled with fresh water.

In this case, the water supply tank draining step can be automatically performed during or after the first alarm step.

Also, in case an alarm signal according to the first alarm step is made, the draining step can be selectively performed by the decision of the user.

That is, even through the storage period of water exceeds the validity period of water, the water supply tank draining step can be performed by the decision of the user.

The meaning of the phrase that "water supply tank draining step can be performed by the decision of the user" indicates a case that the user commands normal operation of the clothes treating apparatus during or after the first alarm step, and a case that normal operation is performed or the water supply tank is drained without considering the result of judgement.

For the latter case, a water supply tank draining button is preferably provided at an outside the cabinet of the clothes treating apparatus. And, the alarm step could be a visual alarm and/or an audible alarm made by an illumination unit or a speaker unit.

Also, the controlling method of the clothes treating apparatus according to the present invention may further includes a second alarm step of alarming necessity of water supply into the water supply tank when the water supply tank draining step is performed.

That is, since the judging step of determining whether water can be re-used is performed when the user commands the operation of the clothes treating apparatus, the second alarm step serves to inform the user, who expects normal operation of the clothes treating apparatus, of the necessity of water supply as the water supply tank is drained.

Figure 4:
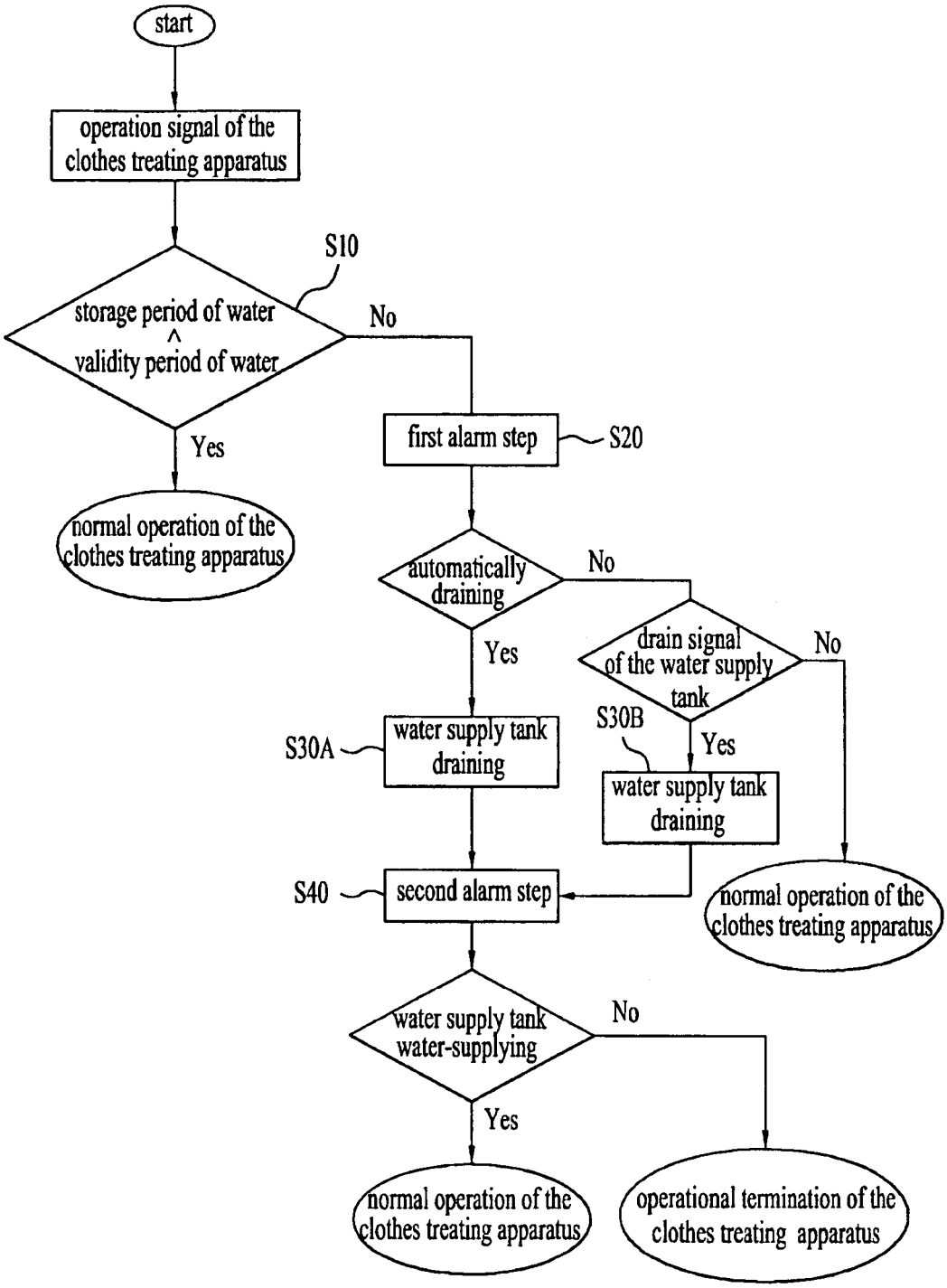
FIG. 4 is a block diagram related to a controlling method of a clothes treating apparatus according to the present invention.

FIG. 4 is a black diagram related to a controlling method of a clothes treating apparatus according to the present invention.

If water in the water supply tank is determined to be usable in the judging step (S10), the clothes treating apparatus can be normally operated. If it is determined to be unusable in the judging step (S10), the a first alarm step (S20) of informing the user of this fact is performed, the water supply tank draining step (S30A) is performed in a state where an automatic draining function is set, and the water supply tank draining step (S30B) is performed when a water supply tank draining signal is input by the user in a state where the automatic draining function is not set.

In case the automatic draining function is not set, the operation of the clothes treating apparatus may be stopped when the water supply tank draining signal is not input, however the user may allow the clothes treating apparatus to normally operate assuming that the intention of the user is normal operation.

In the other case, i.e. in case the water supply tank draining signal is not input by the user, the operation of the clothes treating apparatus can be stopped.

After the water supply tank draining step (S30A, S30B) is performed, the second alarm step (S40) of informing the user that the water supply tank is drained can be further included.

Since a series of processes, which drain water inside the water supply tank, can be performed when the operation signal of the clothes treating apparatus is input by the user, the intention of the user is considered as that the user will normally operate the clothes treating apparatus by supplying fresh water into therein, and therefore the alarm step of alarming necessity of water supply is performed.

Therefore, the clothes treating apparatus can be normally operated when the user supplies fresh water according to the alarm signal produced in the second alarm step (S40), the operation of the clothes treating apparatus can also be terminated after a pre-determined lapse of time.

Also, according to the present invention, there is provided a controlling method of a clothes treating apparatus that treats clothes by supplying steam generated in a steam generator into an accommodating space where the clothes are received, including: a water collecting tank water-supplying step of supplying water inside the steam generator 25 into a water collecting tank 29 where water drained from the clothes treating apparatus is stored.

Figure 5:
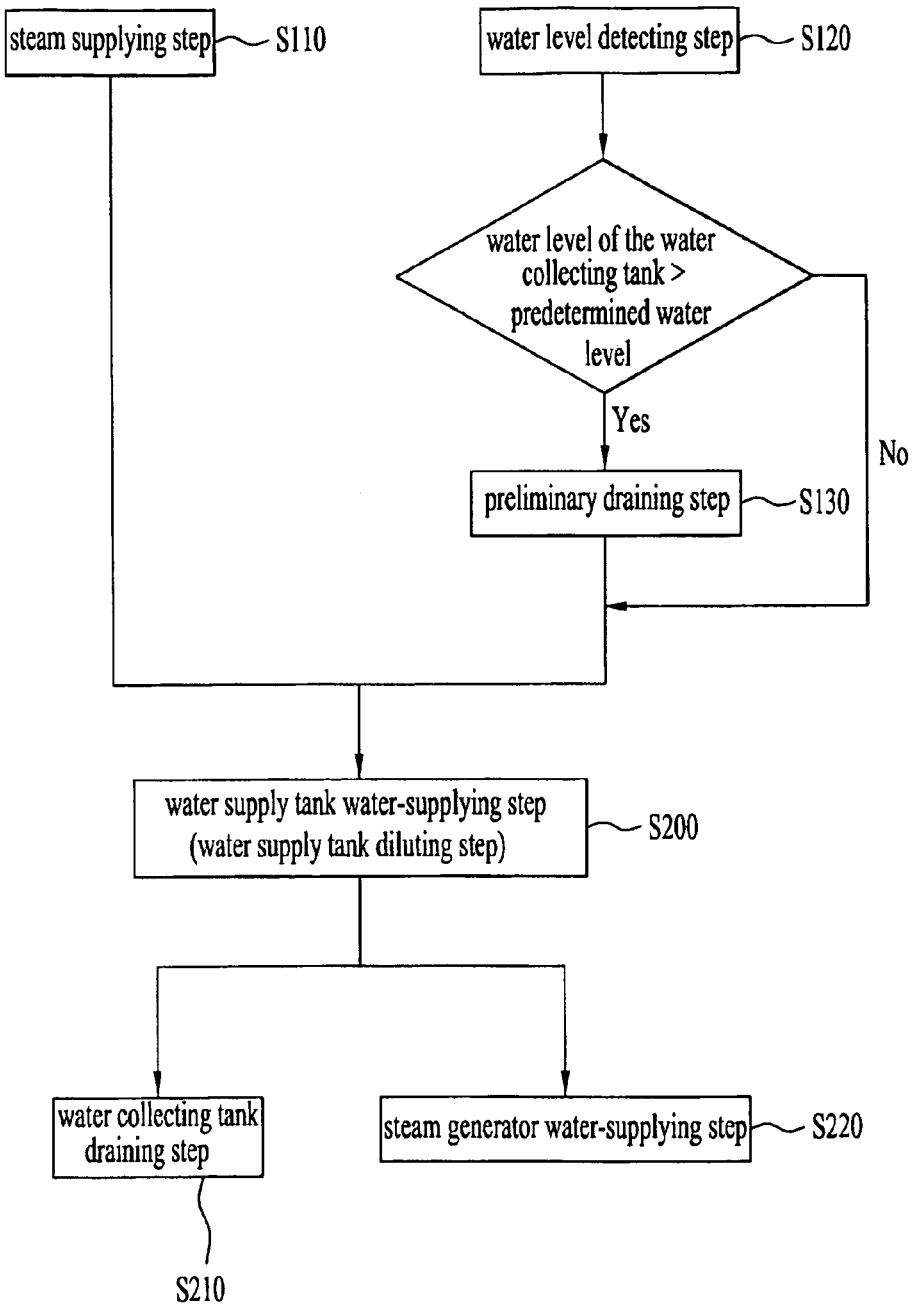
FIG. 5 is a block diagram related to a controlling method of a clothes treating apparatus according to another embodiment of the present invention.

FIG. 5 is a block diagram related to a controlling method of a clothes treating apparatus according to another embodiment of the present invention.

The water collecting tank water-supplying step (S200) indicates a water collecting tank diluting step of diluting water inside the water collecting tank 29 where water inside the steam generator 25 and condensate water of the clothes treating apparatus are collected.

In the water collecting tank water-supplying step (S200), water is supplied into the water collecting tank 29 via the steam generator in the same manner as the water supply tank draining step.

the reason why water is supplied into the water collecting tank is that smells may be produced or parts in the draining path may be corroded when water is remained in the water collecting tank 29, because water inside the water collecting tank 29 is polluted at a considerable level.

Therefore, it is necessary to reduce the contaminant degree or to dilute pollutants by supplying water inside the steam generator 25, before draining water inside the water collecting tank 29.

Smells caused by drainage water may nauseate the user while emptying water collected in the drain tank 70 and may damage the satisfaction of the user, since smells may remain in the water collecting tank 29 or the drain tank 70.

The controlling method of the clothes treating apparatus according to the present invention may further include a water collecting tank draining step (S210) of draining water inside the water collecting tank 29 into a detachable drain tank. That is, water, which is supplied from the steam generator 25 into the water collecting tank 29 in the water collecting tank water-supplying step (S200), may be diluted with drainage water inside the water collecting tank 29 and be drained.

The water collecting tank draining step (S210) can be performed by the operation of the drain pump provided in the water collecting tank 29 or on the pipe for connecting the water collecting tank with the drain tank 70. The drain pump, as shown in FIG. 2, may be installed on the pipe for connecting the water collecting tank 29 with the drain tank 70, and it may also be provided in the water collecting tank 29.

In the controlling method of the clothes treating apparatus according to the present invention, the steam generator 25 is used as the moisture supply apparatus, as described above. Therefore, in order to supply steam to clothes received in the accommodating space 10, if the heated water in the steam generator 25 is used in the water collecting tank water-supplying step (S200) because water in the steam generator 25 is in a state of high temperature, an effect of washing out water inside the water collecting tank 29 can be produced.

Therefore, the water collecting tank water-supplying step (S200) can be performed after a steam supplying step of supplying steam from the steam generator to the accommodating space.

Also, water supplied into the water collecting tank 29 in the water collecting tank water-supplying step can be supplied from the water source, which supplies water into the steam generator 25, or from the water supply tank 90 into the water collecting tank 29. FIG. 2 shows the detachable water supply tank 90, however the water source such as the waterworks can be used as described above.

And, the water collecting tank water-supplying step (S200) can be performed by a method of opening the water source or water supply tank 90, and the control valve provided on the pipe that connects the steam generator 25 with the water collecting tank 29. The method of supplying water from the water source or water supply tank 90 into the water collecting tank 29 is the same as that in the water supply tank draining step.

Also, the water collecting tank 29 may further include a water-level sensor that measures the level of water by sensing whether electric current is flowed through electrodes inside the water collecting tank, wherein a water-level measuring step (S120) of measuring the level of water in the water collecting tank by means of the water-level sensor may be included before the water collecting tank water-supplying step (S200).

Since the water collecting tank water-supplying step supposes that a surplus space for accommodating fresh water is left in the water collecting tank 29, in case highly contaminated condensate water is filled in the water collecting tank 29, after some or all of the water inside the water collecting tank 29 is drained into the drain tank, fresh water is further drained into the drain tank 70 via the water collecting tank 29 in order to dilute the contaminated condensate water in the drain tank.

Therefore, in case the level of water inside the water collecting tank 29 is below the predetermined level, the water collecting tank water-supplying step (S200) can be performed, and in case the level of water inside the water collecting tank 29 is equal to or higher than the predetermined level, a preliminary draining step (S130) of draining a predetermined amount of water from the water source or water supply tank 90 into the drain tank 70 via the steam generator 25 and water collecting tank 29 can be further included.

Also, the water collecting tank water-supplying step (S200) of the controlling method of the clothes treating apparatus according to the present invention can be performed, after condensate water generated in the dehumidification process, which dehumidifies air inside the accommodating space, is collected in the water collecting tank.

This is to minimize the period that the highly contaminated condensate water remains in the water collecting tank 29 without being diluted.

The water collecting tank water-supplying step (S200) or the water collecting tank diluting step supplies water into the steam generator. The steam generator 25, as described above, uses an electric heater, and the electric heater heats water surrounding the electric heater by means of electric currents supplied from the outside. However, since the electric heater can be corroded or damaged when electric currents are applied to the electric heater in the air, a minimum level of water that allows the overall electric heater to be submerged must be maintained.

In order to determine whether this minimum level of water is satisfied, in the same manner as the sump, an electrode sensor that measures the level of water by sensing whether electric current is flowed through a plurality of electrodes can be provided therein.

Therefore, the method may further includes a steam generator water-supplying step (S220) of selectively supplying water from a water source or the water supply tank, which supplies water to the steam generator, into the steam generator according to the level of water in the steam generator during or after the water collecting tank water-supplying step or the water collecting tank diluting step in order to allow water in the steam generator to be reached to the minimum level of water for protecting the electric heater after the water collecting tank water-supplying step.

As described above, the steam generator water-supplying step (S220) may be performed by opening the valve provided on the pipe for connecting the water source or water supply tank 70 with the steam generator 25 or by operating the pump.

If the water collecting tank draining step (S210) is performed, the diluted drainage water will be stored in the drain tank 90. Smells or contaminations, which can be generated from the drain tank, will be reduced than the case of draining it without being diluted.

Although preferred embodiments of the present invention have been described and illustrated, It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The invention claimed:

1. A method of controlling a clothes treating apparatus that treats received clothes using steam generated in a steam generator, the method comprising:

a water supply tank draining step, comprising draining water received in a detachable water supply tank, the water supply tank for supplying water to the steam generator into a detachable drain tank via the steam generator; and a judging step, comprising determining whether water received in the water supply tank can be used in the steam generator, wherein the water supply tank draining step is performed based on the result of the judging step, and wherein the judging step comprises:

a storage period comparing step, comprising comparing a validity period of water with a storage period of the water received in the water supply tank.

2. The controlling method of the clothes treating apparatus according to claim 1, wherein the water supply tank draining step is performed when the storage period is longer than the validity period.

3. The controlling method of the clothes treating apparatus according to claim 1, wherein it is determined that water can be used when the storage period is shorter than the validity period.

4. The controlling method of the clothes treating apparatus according to claim 3, wherein the storage period of the water received in the water supply tank is based on a most recent mounting time of the water supply tank.

5. The controlling method of the clothes treating apparatus according to claim 3, wherein a starting point of the storage period is based on a most recent time at which the steam generator starts to generate steam.

6. The controlling method of the clothes treating apparatus according to claim 3, further comprising:

a first alarm step, comprising displaying the result of the judging step when it is determined in the judging step that the water cannot be used.

7. The controlling method of the clothes treating apparatus according to claim 6, further comprising automatically performing the water supply tank draining step after the first alarm step.

8. The controlling method of the clothes treating apparatus according to claim 1, wherein the water supply tank draining step is performed in response to a drain signal.

9. The controlling method of the clothes treating apparatus according to claim. 6, wherein the water supply tank draining step is performed in response to a drain signal.

10. The controlling method of the clothes treating apparatus according to claim 7, further comprising:

a second alarm step, comprising generating an alarm indicating water supply is necessary when the water supply tank draining step is terminated.

11. The controlling method of the clothes treating apparatus according to claim 9, further comprising:

a second alarm step, comprising generating an alarm indicating water supply is necessary when the water supply tank draining step is terminated.

* * * * *